US012721443B2

(12) United States Patent
Oomen et al.

(10) Patent No.: US 12,721,443 B2
(45) Date of Patent: Sep. 1, 2026

(54) APPARATUS AND METHOD FOR MANUFACTURING A SUPPORT FRAME FOR A SEAT ASSEMBLY

(71) Applicant: ILLINOIS TOOL WORKS INC., Glenview, IL (US)

(72) Inventors: Craig Oomen, Rockford, MI (US); Sam Smith, Allendale, MI (US); Randy Sayers, Belding, MI (US); Kelly Washburn, Allegan, MI (US)

(73) Assignee: Illinois Tool Works Inc., Glenview, IL (US)

( * ) Notice: Subject to any disclaimer, the term of this patent is extended or adjusted under 35 U.S.C. 154(b) by 240 days.

(21) Appl. No.: 18/409,704

(22) Filed: Jan. 10, 2024

(65) Prior Publication Data

US 2024/0225292 A1 Jul. 11, 2024

Related U.S. Application Data

(60) Provisional application No. 63/438,277, filed on Jan. 11, 2023.

(51) Int. Cl.
*A47C 7/28* (2006.01)
*A47C 7/44* (2006.01)

(52) U.S. Cl.
CPC ..... *A47C 7/441* (2013.01); *A47C 7/44* (2013.01); *A47C 7/28* (2013.01)

(58) Field of Classification Search
CPC ..... A47C 7/44; A47C 7/441; A47C 7/282
USPC ..... 297/452.15
See application file for complete search history.

(56) References Cited

U.S. PATENT DOCUMENTS 4,733,910 A * 3/1988 Brennan ..... A47C 3/04 297/285
4,776,633 A * 10/1988 Knoblock ..... A47C 3/18 297/285
4,856,846 A * 8/1989 Lohmeyer ..... A47C 3/12 297/285
4,913,493 A * 4/1990 Heidmann ..... A47C 7/448 297/285
4,962,964 A * 10/1990 Snodgrass ..... A47C 7/024 297/452.15 X (Continued)

FOREIGN PATENT DOCUMENTS

JP 2013132402 A 7/2013
KR 101833840 B1 3/2018
TW M479074 U 6/2014

OTHER PUBLICATIONS

European Search Report for EP 24151450.4, dated May 14, 2024, 7 pages.

*Primary Examiner* — Rodney B White
(74) *Attorney, Agent, or Firm* — Quarles & Brady LLP

(57) ABSTRACT

A seat assembly includes a frame made from a first material having a first hardness, the frame including a first side and a second side opposite the first side. The seat assembly further includes a fabric component coupled to the first side of the frame, and a plurality of grooves are disposed within the second side of the frame. Each insert of a plurality of inserts are disposed within each respective groove in the plurality of grooves. Each insert of the plurality of inserts comprises a second material and the second material has a second hardness that is less than the first hardness.

12 Claims, 7 Drawing Sheets

(56) References Cited

U.S. PATENT DOCUMENTS 5,333,934 A * 8/1994 Knoblock ..... A47C 1/03255 297/452.15 X
5,352,022 A * 10/1994 Knoblock ..... A47C 1/03277 297/452.15 X
5,487,591 A * 1/1996 Knoblock ..... A47C 3/12 297/452.15 X
5,611,598 A * 3/1997 Knoblock ..... A47C 3/245 297/452.15 X
6,767,066 B1 7/2004 Tornero
6,877,816 B1 * 4/2005 Farmont ..... A47C 31/126 297/284.1 X
7,021,718 B2 4/2006 Coffield et al.
7,114,782 B2 * 10/2006 Ambasz ..... A47C 5/04 297/239
7,320,503 B2 * 1/2008 Eysing ..... B60N 2/914 297/452.15 X
7,618,572 B2 11/2009 Coffield
7,648,201 B2 * 1/2010 Eysing ..... A47C 7/46 297/284.3
7,677,873 B2 3/2010 Sayers et al.
7,926,879 B2 * 4/2011 Schmitz ..... A47C 1/03255 297/340
8,066,501 B2 11/2011 Sayers et al.
8,282,169 B2 * 10/2012 Schmitz ..... A47C 7/462 297/411.25
8,329,281 B2 12/2012 Coffield
8,414,073 B2 * 4/2013 Schmitz ..... A47C 1/03288 297/321
8,465,007 B2 6/2013 Coffield et al.
8,567,864 B2 * 10/2013 Deisig ..... A47C 3/045 297/285
8,616,655 B2 12/2013 Jung
8,820,835 B2 * 9/2014 Minino ..... A47C 7/44 297/285
8,967,726 B2 * 3/2015 Schmitz ..... A47C 1/03294 297/452.56
9,156,211 B2 10/2015 Coffield
9,572,432 B2 * 2/2017 Deisig ..... A47C 7/44
9,668,580 B2 * 6/2017 Schmitz ..... A47C 7/54
10,016,060 B2 * 7/2018 Schmitz ..... A47C 7/44
10,070,727 B2 * 9/2018 Burwell ..... A47C 7/46
10,874,220 B2 12/2020 Aldrich et al.
11,134,792 B2 10/2021 Case et al.
11,452,380 B2 9/2022 Oomen et al.
11,690,454 B2 7/2023 Oomen et al.
11,820,258 B2 * 11/2023 Bahr ..... A47C 3/021
2003/0001420 A1 1/2003 Koepke et al.
2003/0080595 A1 5/2003 Wilkerson et al.
2003/0168901 A1 9/2003 Wilkerson et al.
2003/0209935 A1 11/2003 Legal
2004/0183348 A1 * 9/2004 Kniese ..... A47C 7/405 297/284.1 X
2009/0315384 A1 12/2009 Yang et al.
2009/0317600 A1 12/2009 Lee
2020/0039399 A1 2/2020 Oomen et al.
2021/0315384 A1 10/2021 Oomen et al.
2021/0353067 A1 11/2021 Oomen et al.

* cited by examiner

APPARATUS AND METHOD FOR MANUFACTURING A SUPPORT FRAME FOR A SEAT ASSEMBLY

CROSS REFERENCE TO RELATED APPLICATIONS

The present application claims the benefit of U.S. Provisional Application No. 63/438,277, filed on Jan. 11, 2023, which is incorporated herein by reference in its entirety.

REFERENCE REGARDING FEDERALLY SPONSORED RESEARCH OR DEVELOPMENT

Not applicable

SEQUENCE LISTING

Not applicable

BACKGROUND

1. Field of the Disclosure

The present disclosure relates generally seat assemblies, and more specifically, to a seat assembly that includes a flexible support frame.

2. Description of the Background

Seat assemblies, such as office furniture, often use a fabric suspension structure. Typically, a fabric suspension seat assembly includes a support frame disposed along a perimeter of a fabric. The fabric extends across the support frame to provide a surface on which a user can sit. The fabric often secures to a carrier component that is then attached to the support frame. In some examples, the support frame includes a return flange for supporting the fabric surface in a load bearing state, and a channel for receiving the carrier. The carrier is usually overmolded to the stretched fabric, and the support frame is typically molded as a single, rigid element to maintain suspension of the fabric surface during use. However, rigid support frames provide limited flexibility, which may result in increased stress points and, therefore, failure points. Further, rigid seat assemblies are limited in the comfort they can provide to a user. Accordingly, there exists a need for seat assemblies with increased flexibility to provide increased comfort to users while ensuring that fabric surfaces are properly suspended during use.

SUMMARY

In some aspects, a seat assembly includes a frame comprising a first material that defines a first hardness, the frame including a first side and a second side opposite the first side. The seat assembly further includes a fabric component coupled to the first side of the frame, and a plurality of grooves are disposed within the second side of the frame. Each insert of a plurality of inserts are disposed within each respective groove in the plurality of grooves. Each insert of the plurality of inserts comprises a second material, the second material defining a second hardness that is less than the first hardness.

In some aspects, the second hardness is between about 25% and about 99% of the first hardness. In some aspects, the frame defines a linear portion that extends in a substantially parallel direction with respect to a longitudinal axis and a curved portion that extends rearwardly of the linear portion. In some aspects, a majority of inserts of the plurality of inserts are disposed within the curved portion of the frame. In some aspects, each insert of the plurality of inserts is configured to deform in response to applying a load to the first side of the frame such that the curved portion of the frame is configured to flex in a rearward direction. In some aspects, the frame further includes a third side and a fourth side each coupled to the first side and the second side, and the plurality of inserts are at least partially visible when viewed from the second side, the third side, and the fourth side. In some aspects, the first material defines a first modulus of elasticity and the second material defines a second modulus of elasticity that is between about 25% and about 99% of the first modulus of elasticity.

In some aspects, a seat assembly includes a frame defining a first length and including a first side and a second side opposite the first side. The seat assembly further includes a fabric component coupled to the first side of the frame. A plurality of grooves is disposed within the second side of the frame, and a plurality of inserts is disposed within the plurality of grooves. The plurality of inserts defines an insert area having a second length that is less than the first length.

In some aspects, the frame comprises a first material that defines a first hardness and the plurality of inserts comprises a second material that defines a second hardness, and the second hardness is less than the first hardness. In some aspects, the frame defines a linear portion that extends in a substantially parallel direction with respect to a longitudinal axis and a curved portion that extends rearwardly of the linear portion. In some aspects, a third length of the linear portion is greater than a fourth length of the curved portion. In some aspects, the curved portion defines a first radius of curvature in an unloaded state and a second radius of curvature in a loaded state, and the second radius of curvature is greater than the first radius of curvature. In some aspects, the insert area of the plurality of inserts is located between about 40% and about 90% of the first length of the frame. In some aspects, the frame further includes a third side and a fourth side each coupled to the first side and the second side, and the plurality of inserts are at least partially visible when viewed from the second side, the third side, and the fourth side. In some aspects, the plurality of grooves includes between one and 100 grooves.

In yet another aspect, a method of manufacturing a seat assembly includes tensioning a fabric component within a mold, injecting a first material into the mold to form a frame having a plurality of grooves disposed therein, injecting a second material into the mold to form a plurality of inserts within the plurality of grooves, and coupling the fabric component to the frame. The first material of the frame has a first hardness that is greater than a second hardness of the second material of the plurality of inserts.

In some aspects, coupling the fabric component to the frame includes coupling a fastener to the fabric component and the frame. In some aspects, the second hardness is between about 25% and about 99% of the first hardness. In some aspects, the mold includes a first molding block and a second molding block, the fabric component being tensioned to the first molding block. In some aspects, the fabric component is tensioned on a stretching assembly.

Various alternative implementations of the foregoing aspects are disclosed. The foregoing various aspects may be combined in any manner without limitation. The foregoing and other aspects and advantages of the disclosure will appear from the following description. In the description, reference is made to the accompanying drawings, which form a part hereof, and in which there is shown by way of illustration a preferred configuration of the disclosure. Such configuration does not necessarily represent the full scope of the disclosure, however, and reference is made therefore to the claims herein for interpreting the scope of the disclosure.

BRIEF DESCRIPTION OF THE DRAWINGS

The present disclosure will be better understood and features, aspects, and advantages other than those set forth above will become apparent when consideration is given to the following detailed description thereof. Such detailed description makes reference to the following drawings.

DETAILED DESCRIPTION OF THE DRAWINGS

Figure 1:
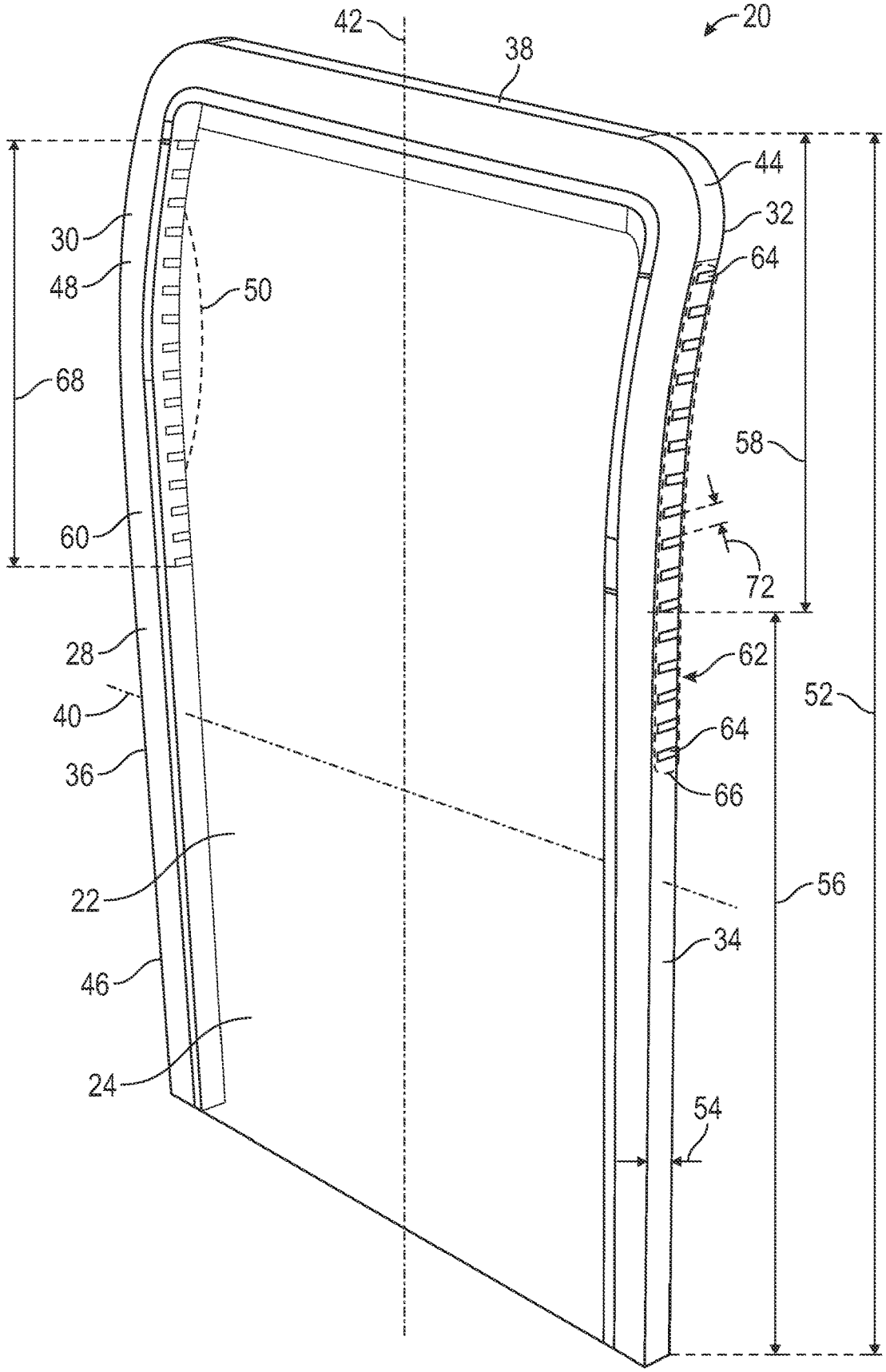
FIG. 1 is an isometric view of a front, right, and top side of a seat assembly arranged in a first position, according to aspects of the present disclosure.

The features, aspects and advantages are described below with reference to the drawings, which are intended to illustrate but not to limit the present disclosure. While the systems disclosed herein may be embodied in many different forms, several specific embodiments are discussed herein with the understanding that the embodiments described in the present disclosure are to be considered only exemplifications of the principles described herein, and the disclosure is not intended to be limited to the embodiments illustrated. Throughout the disclosure, the terms "about" and "approximate" mean plus or minus 5% of the number or value that each term precedes. In the drawings, like reference characters denote corresponding features consistently throughout the drawings. Also, while the terms "front side," "rear side," "top side," "side," "forward," and "rearward" and the like may be used in this specification to describe various example features and elements, these terms are used herein as a matter of convenience, e.g., based on the example orientations shown in the figures and/or the orientations in typical use. Unless otherwise stated, nothing in this specification should be construed as requiring a specific three dimensional or spatial orientation of structures in order to fall within the scope of the claims.

The terms "weight percent," "wt-%," "percent by weight," "% by weight," and variations thereof, as used herein, refer to the concentration of a substance or component as the weight of that substance or component divided by the total weight, for example, of the composition or of a particular component of the composition, and multiplied by 100. It is understood that, as used herein, "percent," "%," and the like may be synonymous with "weight percent" and "wt-%." As used herein in the context of geometric descriptions, unless otherwise limited or defined, "substantially" indicates correspondence to a particular shape or dimension within conventional manufacturing tolerances for components of a similar type or that are formed using similar processes. In this regard, for example, "substantially round" can indicate a profile that deviates from a circle to within acceptable manufacturing tolerances.

The following discussion and accompanying figures disclose various embodiments or configurations of seat assembly including a fabric component and a frame. Although embodiments of a fabric component or frame are discussed with reference to a back or seat member of a chair, such as an office chair, concepts associated with embodiments of the seat assembly or frame may be applied to a wide range of fabric suspension and/or furniture applications including, e.g., stadium seating, automotive seating or framing, home and office furniture, etc. Accordingly, the concepts described herein may be utilized in a variety of products.

With reference to FIGS. 1-6, a seat assembly 20 is illustrated that includes a back member or fabric component 22. The fabric component 22 has a front surface 24 opposite a rear surface 26 and extends across a frame or frame member 28 such that the fabric component 22 is stretched or tensioned to provide the front surface 24 in a suspended state and capable of supporting a user in a seated position.

Figure 2:
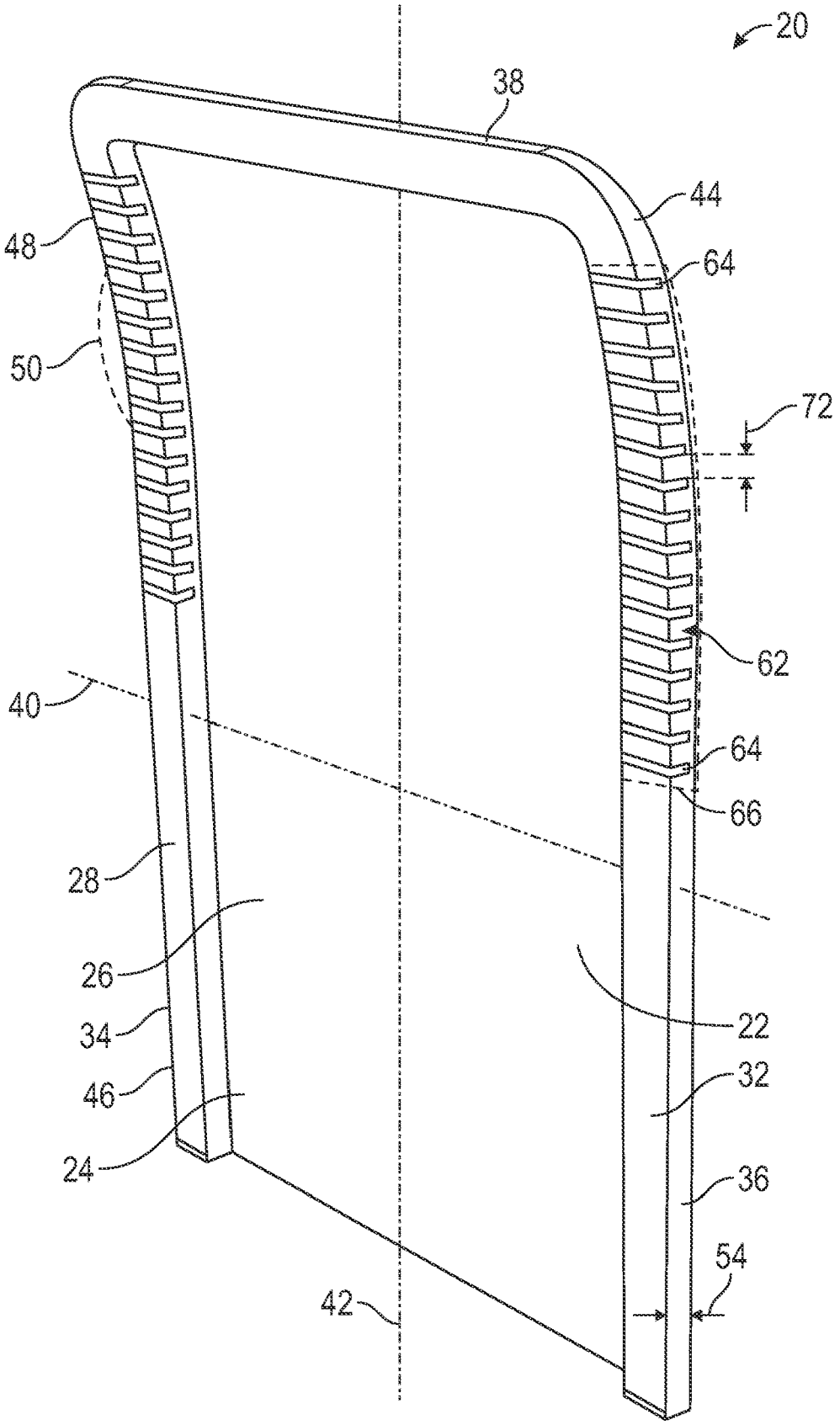
FIG. 2 is an isometric view of a rear, left, and top side of the seat assembly of FIG. 1.

As depicted in FIGS. 1 and 2, the fabric component 22 comprises a plurality of fibers that are woven or arranged together, with all or some of the fibers being formed of a flexible material or resin. For example, the fabric component 22 may comprise a knitted component, a woven textile, a non-woven textile, leather, mesh, suede, and/or a combination of one or more of the aforementioned materials. The fabric component 22 may be formed by way of warp knitting, weft knitting, flat knitting, circular knitting, and/or other suitable knitting operations. The fabric component 22 may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double-cloth weaves, for example. Non-woven textiles include textiles made by air-laid and/or spun-laid methods, for example. The fabric component 22 may comprise a variety of materials that may have varying properties or visual characteristics. For example, some or all of the fibers of the fabric component 22 may be formed of a fiberglass or a thermoplastic material or resin, or a combination thereof. The plurality of fibers may be bonded or fastened together and oriented lengthwise with respect to one another and along a top-to-bottom length of the frame 28 or a side-to-side length of the frame 28. The melting temperature of the fabric component 22 depends at least in part on the selection or combination of material or resin of the plurality of fibers, which may be configured to have a low average melting temperature relative to the average melting temperature of the material of the frame 28.

Further, the frame 28 defines a plurality of sides, such as a first or front side 30, a second or rear side 32, a third or right side 34, a fourth or left side 36, and a fifth or top side 38. In some examples, the frame 28 further includes a sixth or bottom side (not shown). A transverse axis 40 extends between portions of the right and left sides 34, 36 of the frame 28 that extend in substantially parallel directions with respect to one another, and a longitudinal axis 42 extends in a direction that is perpendicular with respect to the transverse axis 40. Together, the transverse axis 40 and the longitudinal axis 42 define a horizontal reference plane (not shown). In some aspects, the sides 30, 32, 34, 36 of the frame 28 are planar sides, or the sides 30, 32, 34, 36 include one or more curves such that the frame 28 defines, at least in part, a curved profile with respect to transverse axis 40 and/or the longitudinal axis 42.

For example, the right and left sides 34, 36 extend upward from the bottom side (not shown) and substantially parallel with respect to the longitudinal axis 42 before convexly curving upward and rearward away from the horizontal plane (not shown). The right and left sides 34, 36 terminate in rounded corners 44 which serve as joints between the top side 38 and the right and left sides 34, 36, respectively. Correspondingly, the frame 28 includes a linear portion 46 that extends in substantially parallel direction with respect to the longitudinal axis 42 and a convexly curved portion 48 that extends rearwardly of the linear portion 46, i.e., the horizontal plane (not shown). In some aspects, the linear portion 46 of the frame 28 is configured to support a user's lower back, e.g., the lumbar region of a user's lower back, when the seat assembly 20 is being used, and a convexly curved portion 48 of the frame 28 is configured to support a user's upper back, e.g., above the lumbar region. It is contemplated that the curved portion 48 defines a plurality of radii of curvature that correspond to a non-compressed or first position of the seat assembly 20, including a first radius of curvature 50. In some aspects, the curved portion 48 extends rearwardly of the linear portion 46, i.e., rearwardly of the horizontal plane (not shown).

With continued reference to FIGS. 1 and 2, various dimensions of the seat assembly 20 and the frame 28 are illustrated. Specifically, the frame 28 defines a frame length 52 that includes a linear length 56 defined a length of the linear portion 46 measured along the longitudinal axis 42, and a curved length 58 defined as length of the curved portion 48. In addition, the frame 28 defines a width 54 that is measured between the right and left sides 34, 36 of the frame 28. In some aspects, the linear length 56 of the frame 28 in the first position is between about 50% and about 75% of the frame length 52, or between about 60% and about 70% of the frame length 52, or about 65% of the frame length 52. In some aspects, the curved length 58 of the frame 28 is between about 25% and about 50% of the frame length 52, or between about 30% and about 40% of the frame length 52, or about 35% of the frame length 52.

Moreover, the frame 28 may be integrally formed of a material or resin, or a combination thereof, that can comprise a resilient polymer such as any thermoplastic. For example, the thermoplastic can include nylon, glass-filled nylon, polypropylene, acetyl, or polycarbonate; any thermal set material, including epoxies; or any resin-based composites, including carbon fiber or fiberglass, thereby allowing the frame 28 to conform and move in response to force exerted by a user. The frame 28 may be formed from a wide variety of polymeric materials, including, for example, polyethylene (PE), low density polyethylene (LDPE), high density polyethylene (HDPE), polyethylene terephthalate (PET), crystalline PET, amorphous PET, polyethylene glycol terephthalate, polystyrene (PS), polyamide (PA), polyvinyl chloride (PVC), polycarbonate (PC), poly(styrene: acrylonitrile) (SAN), polymethylmethacrylate (PMMA), polypropylene (PP), polyethylene naphthalene (PEN), polyethylene furanoate (PEF), PET homopolymers, PEN copolymers, PET/PEN resin blends, PEN homopolymers, overmolded thermoplastic elastomers (TPE), polybutylene terephthalate (PBT) copolymers, fluoropolymers, polysulphones, polyimides, cellulose acetate, and/or combinations thereof. In some aspects, the material or combination of materials that comprise the frame 28 are referred to herein as a "first material." In some aspects, the first material defines a first hardness that that is between about 60 Shore D and about 90 Shore D, or between about 70 Shore D and about 80 Shore D, or about 75 Shore D. In some aspects, the first material defines a first modulus of elasticity that is between about 1 Gigapascal (GPa) and about 10 GPa.

As illustrated in FIGS. 1 and 2, the fabric component 22 is tensioned between the right side 34 and the left side 36 of the frame 28, and, further, between the top side 38 and the bottom side (not shown) of the frame 28. Therefore, the fabric component 22 is tensioned and resilient in multiple, opposing directions comprised of equal and opposite force vectors between the fabric component 22 and the frame 28. In some aspects, the fabric component 22 is molded to the frame 28 to provide a suspension force that is configured to support a user when contacting the front surface 24 of the fabric component 22, e.g., when a user is leaning against the seat assembly 20. In other embodiments, a fastener 60 such as a carrier ring is used to secure the fabric component 22 to the frame 28. For example, the fastener 60 extends within an inner periphery of the front side 30 of the frame 28 to secure the fabric component 22 thereto.

In addition, the frame 28 defines a plurality of grooves 62 along portions of one or more of the front side 30, the rear side 32, the right side 34, and the left side 36. In the non-limiting example illustrated in FIGS. 1-3, the plurality of grooves 62 are formed, at least partially, in each of the rear, right, and left sides 32, 34, 36 of the frame 28 (see FIGS. 1 and 2). A plurality of inserts 64 are configured to be retained within the plurality of grooves 62, meaning that each groove 62 is configured to retain a respective insert 64 therein. Put another way, each groove 62 and each respective insert 64 define a lock-and-key interference fit so as to retain the plurality of inserts 64 within the frame 28. In some aspects, the plurality of inserts 64 are configured to be exposed or uncovered, as will be discussed below in greater detail. Further, in some aspects, the plurality of inserts 64 are at least partially located within the linear portion 46 (see FIG. 1) of the frame 28 and/or the curved portion 48 of the frame 28. For example, a majority of the inserts 64 are disposed within the curved portion 48 of the frame 28 to enhance compliance of the curved portion 48 under load, as will further be discussed below in greater detail.

Relatedly, each of the inserts 64 are integrally formed of a material or resin or a combination thereof that can comprise a resilient polymer such as any thermoplastic. For example, the thermoplastic can include nylon, glass-filled nylon, polypropylene, acetyl, or polycarbonate; any thermal set material, including epoxies; or any resin-based composites, including carbon fiber or fiberglass, thereby allowing the inserts 64 to conform and move in response to force exerted by a user. The inserts 64 may be formed from a wide variety of polymeric materials, including, for example, polyethylene (PE), low density polyethylene (LDPE), high density polyethylene (HDPE), polyethylene terephthalate (PET), crystalline PET, amorphous PET, polyethylene glycol terephthalate, polystyrene (PS), polyamide (PA), polyvinyl chloride (PVC), polycarbonate (PC), poly(styrene: acrylonitrile) (SAN), polymethylmethacrylate (PMMA), polypropylene (PP), polyethylene naphthalene (PEN), polyethylene furanoate (PEF), PET homopolymers, PEN copolymers, PET/PEN resin blends, PEN homopolymers, overmolded thermoplastic elastomers (TPE), polybutylene terephthalate (PBT) copolymers, fluoropolymers, polysulphones, polyimides, cellulose acetate, and/or combinations thereof. In some aspects, the material or combination of materials that comprise each of the inserts 64 are referred to herein as a "second material." In some examples, the second material of the inserts 64 is configured to have a higher modulus of elasticity or elastic modulus than the first material of the frame 28.

The elastic modulus of a substance represents the amount of resistance to deformation (e.g., flexure) offered by a substance, and is generally defined as the slope of the stress-strain curve. In the present disclosure, the terms "resistance" and "flexural resistance" are intended to relate to the elastic modulus. Numerous variables impact the magnitude of the elastic modulus, such as material properties, dimensions, force profiles, or rate of deformation, among other factors. Thus, it is possible to increase or decrease the elastic modulus of a substance by manipulating material properties, or by changing the dimensions, such as thickness or width, or by controlling the magnitude and directions of the forces applied, or by changing the time over which a force is applied. In some applications, one or more of these variables will be fixed and other variables will remain variable.

Referring again to FIGS. 1 and 2, a user exerts a rearward force on the front surface 24 of the fabric component 22 during loading of the seat assembly 20, for example, which then distributes that rearward force to the frame 28 through areas or portions where the fabric component 22 and the frame 28 interact, such as the fastener 60. Since this rearward force could fluctuate and the rate at which the rearward force is applied could fluctuate, such are variables for which the frame 28 and the inserts 64 are designed to accommodate for the purpose of providing enhanced comfort to the user. Accordingly, the material properties, dimensions, proportions, and force profiles of the frame 28 and the inserts 64 can be varied to provide a desirable performance of the seat assembly 20 during loading.

In particular, using two different materials to form the frame 28 and the inserts 64, e.g., the first and second materials, respectively, allows the fabric component 22 and the frame 28 to at least partially flex rearwardly during loading, due to compliance in the rearward direction provided by the position and material of the inserts 64. Put another way, the inserts 64 are configured to deform in response to loading, which in turn allows the curved portion 48 of the frame 28 to flex rearwardly and provide a suspension force for the fabric component 22 that is opposite in direction and equal in magnitude to the force of a user pressing against the front surface 24 of the fabric component 22. Accordingly, use of the inserts 64 transforms the frame 28 into a living hinge that allows selective flexure in a rearward direction in response to experiencing a load. Correspondingly, the material properties, dimensions, and force profile of the frame 28 and the inserts 64 can be tuned or modulated to achieve the desired flexural compliance during loading as discussed below, thereby imparting the desired compliance, and perceived comfort, to the user seated on the seat assembly 20.

In some aspects, the second material of the inserts 64 defines a second hardness that is between about 25% and about 20%, or between about 25% and about 75%, or between about 40% and about 60%, or between about 50% and about 60% of the first hardness of the first material of the frame 28. In some aspects, the second material of the inserts 64 defines a second modulus of elasticity that is between about 25% and about 99%, or between about 25% and about 75%, or between about 40% and about 60%, or between about 50% and about 60% of the first modulus of elasticity of the first material of the frame 28.

Further, the size, shape, and position of the plurality of inserts 64 are configured to provide for flexure of the seat assembly 20 during loading. Still referring to FIGS. 1 and 2, the plurality of inserts 64 defines an insert area 66 on the frame which has a length 68 inclusive of portions of the frame 28 disposed between adjacent inserts 64 on a single side of the frame 28. In some aspects, the length 68 is referred to herein as a combined insert length 68. In some examples, the combined insert length 68 is between about 10% and about 75% of the frame length 52, or between about 25% and about 75% of the frame length 52, or between about 30% and about 50% of the frame length 52, or between about 35% and about 45% of the frame length 52, or about 40% of the frame length 52.

Further, the combined insert length 68 is at least partially located within the linear portion 46 of the frame 28 and/or the curved portion 48 of the frame 28. Accordingly, it will be understood that the combined insert length 68 is measured in a similar way to the linear length 56 and/or the curved length 58 of the frame 28, depending on which portion of the frame 28 the plurality of inserts 64 are disposed within. Relatedly, the plurality of inserts 64 may correspond to the curved portion 48 of the frame 28, meaning that the curved portion 48 of the frame 28 is provided by the location and/or density of inserts 64. In some examples, the plurality of inserts 64 are located between about 25% and about 20% of the frame length 52, measured along the right and left sides 34, 36 of the frame 28 starting from the top side 38. In other examples, the plurality of inserts 64 are located between about 40% and about 90% of the frame length 52, measured along the right and left sides 34, 36 of the frame 28 starting from the top side 38.

Further, each of the inserts 64 can have any suitable shape to provide for flexure of the seat assembly 20 during loading, such as, e.g., rectangular inserts, triangular inserts, ovular inserts, diagonal inserts, etc. In the non-limiting example illustrated in FIG. 3, the inserts 64 are rectangular inserts that are disposed within the rear side 32 of the frame 28 such that the inserts 64 are visible when viewed from the rear, right, and left sides 32, 34, 36 of the frame 28. However, it is contemplated that the inserts 64 may be angled, e.g., extending diagonally with respect to the transverse axis 40 or formed as "V" shapes, in some examples.

Figure 3:
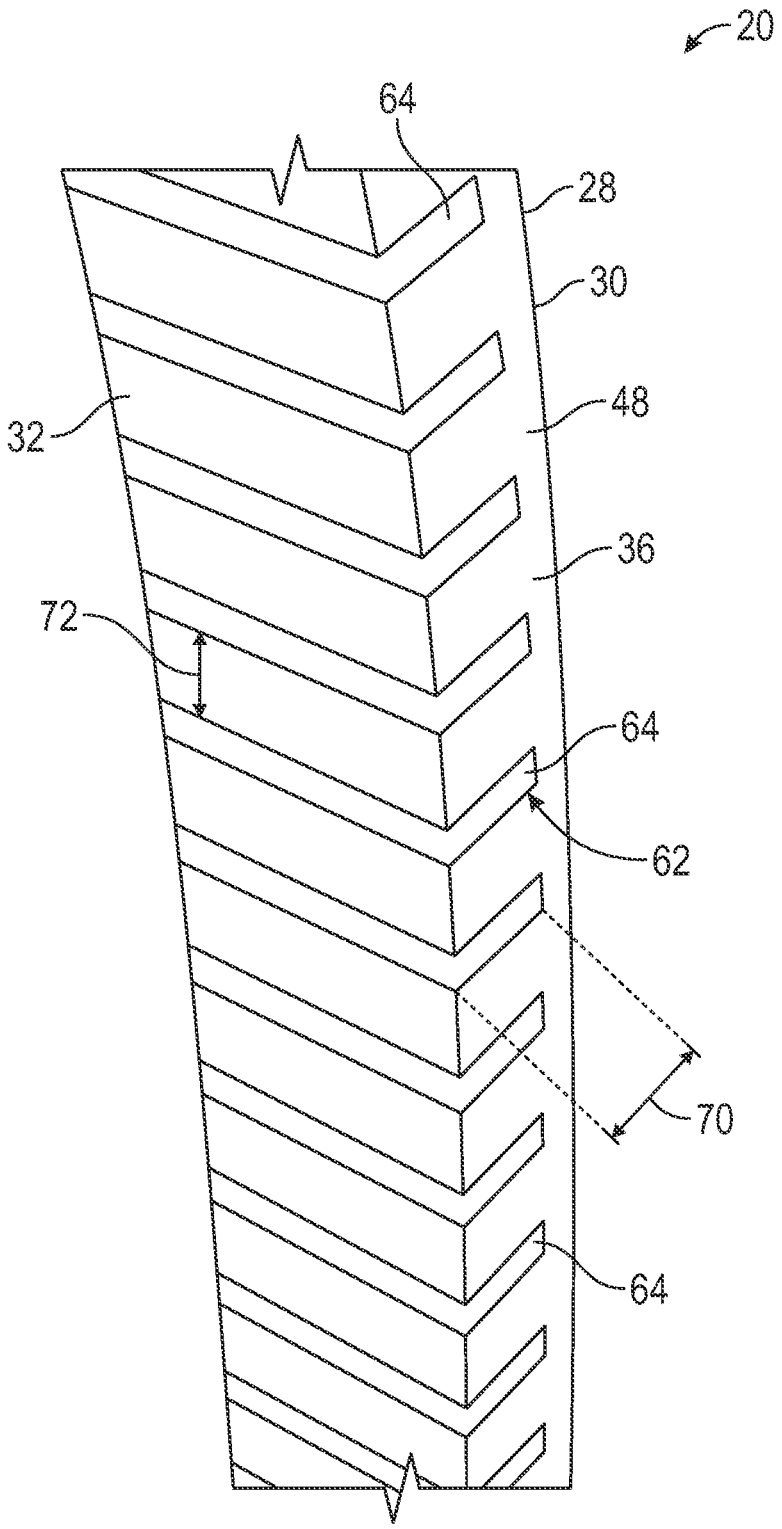
FIG. 3 is a detail view of a support frame in the seat assembly of FIG. 1.

Still referring to FIG. 3, the grooves 62 are open from the rear, right, and left sides 34, 36 of the frame 28, which allows the frame 28 to flex in a rearward direction and prevents the frame 28 from flexing in a forward direction. This in turn enhances perceived comfort when a user is pressing or leaning against the front side 30 of the frame 28, while also maintaining the structural integrity of the seat assembly 20. In some aspects, each of the grooves 62 defines a slot depth 70 that is measured between the front and rear sides 30, 32 of the frame 28, and it is contemplated that the slot depth 70 can be modulated to further control the flexure of the seat assembly 20. For example, increasing the slot depth 70 allows larger inserts 64 to be used in the seat assembly 20, thereby providing increased compliance of the frame 28 during loading.

Moreover, adjacent inserts 64 in the plurality of inserts 64 are illustrated as defining substantially equal spacing therebetween as indicated by arrow 72, although it is contemplated that the spacing 72 can be adjusted to modulate the flexure of the seat assembly 20, as discussed above. Specifically, the grooves 62 and inserts 64 can be sized and shaped to either increase or decrease their impact on the flexural resistance of the frame 28, such as having a greater depth and width to decrease flexural resistance. Further, the grooves 62 and/or inserts 64 may be positioned at consistent incremental distances from each other along the rear, right, and left sides 32, 34, 36 of the frame 28, or at varying distances from one another. For example, the spacing 72 between adjacent grooves 62 may be a distance in a range of between about 0.1 millimeters (mm) and about 10 mm, or between about 2 mm and about 6 mm, or between about 4 mm and about 5 mm. In another aspect, the plurality of grooves 62 can define a gradual spacing such that the density of inserts 64 varies throughout the frame length 52. For example, there may only be one, two, three, or four grooves 62 formed along the bottom 50% of the frame length 52 measured from the bottom side (not shown), while there may be at least seven, eight, nine, or ten grooves 62 disposed along the top 50% of the frame length 52 measured from the top side 38. In some aspects, the frame 28 includes between one and 20 grooves 62 and inserts 64, or between 20 and 80 grooves 62 and inserts 64, or between 30 and 50 grooves 62 and inserts 64, or about 40 grooves 62 and inserts 64.

As discussed above, the non-limiting example illustrated in FIGS. 1-3 depicts the seat assembly 20 as substantially vertical in an unloaded state, i.e., in the first position. Due to the force of a user leaning against the front surface 24 of the fabric component 22, the fabric component 22 may flex rearwardly, away from the horizontal plane (not shown), but use of the deformable inserts 64 allows the frame 28 to flex rearwardly and maintain the suspension force on the fabric component 22 to provide a suspension or hammock support for a user.

Figure 4:
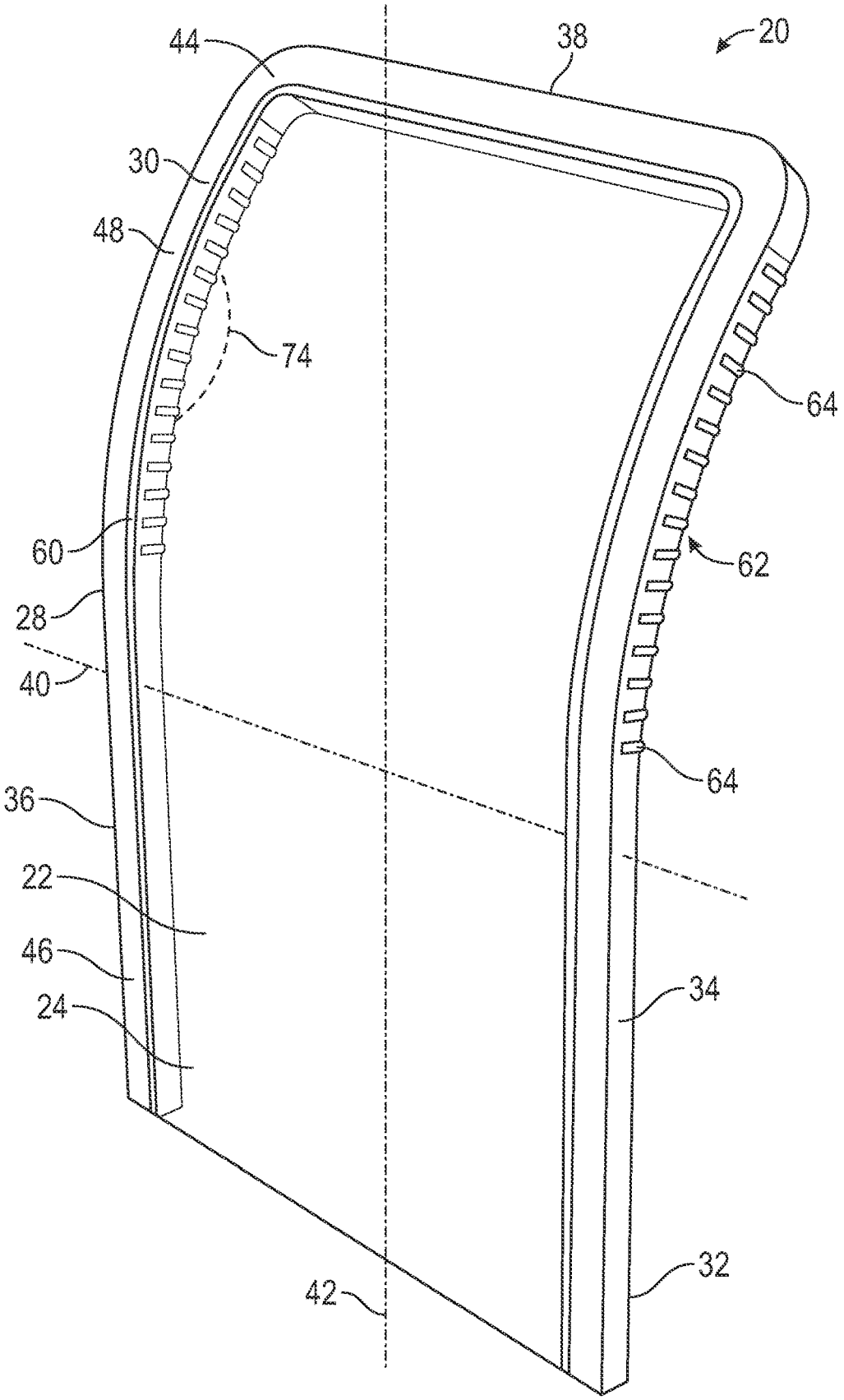
FIG. 4 is an isometric view of the front, right, and top side of the seat assembly of FIG. 1 arranged in a second position.
Figure 5:
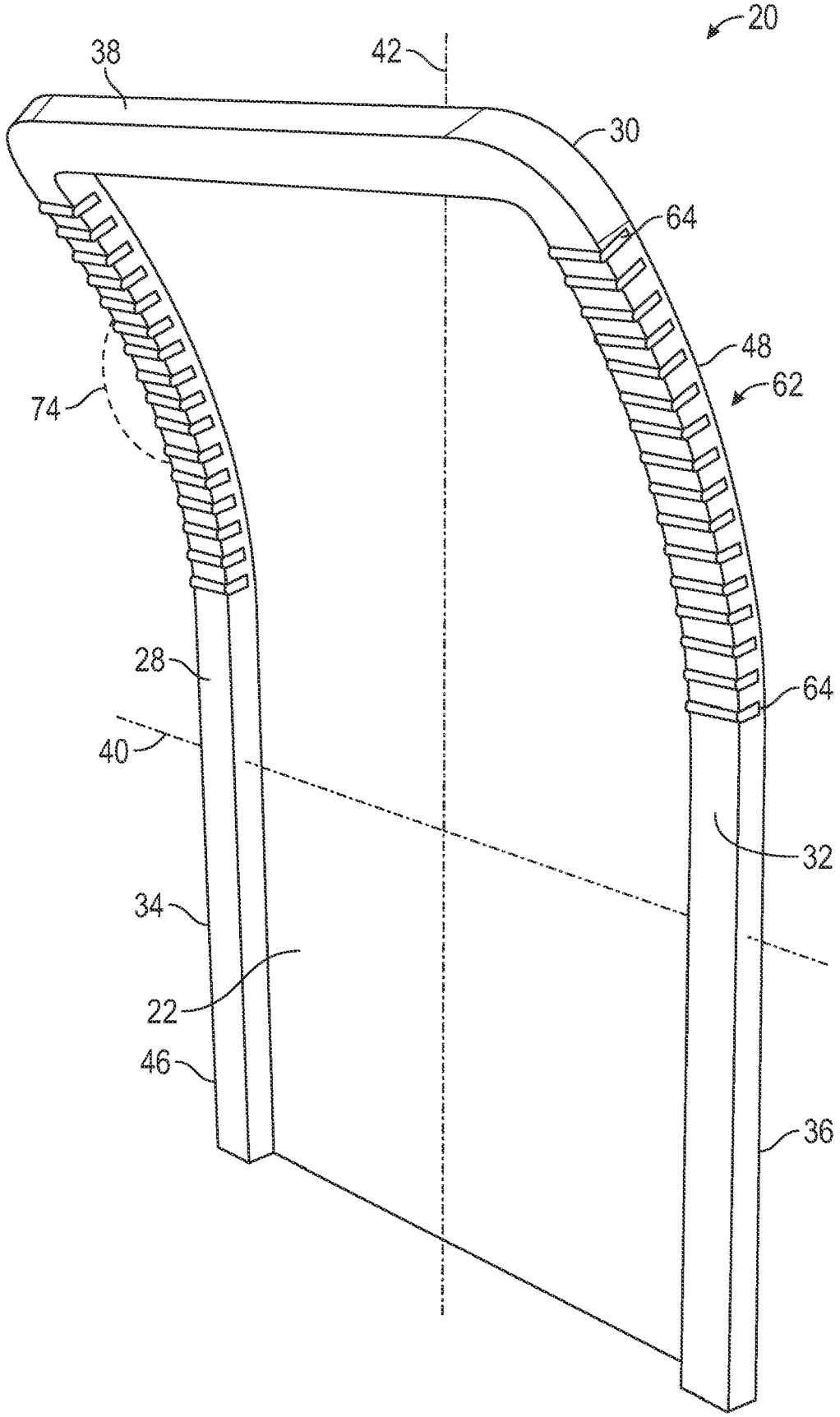
FIG. 5 is an isometric view of the rear, left, and top side of the seat assembly of FIG. 4.

Referring now to FIGS. 4 and 5, the seat assembly 20 is illustrated in a loaded state, which is also referred to herein as a "second position." Specifically, the frame 28 can be seen as flexed rearwardly with respect to the first position due to the living hinge formed by the plurality of grooves 62 and the plurality of inserts 64. For example, the top side 38 of the frame 28 is displaced rearwardly with respect to the horizontal plane (not shown) defined by the transverse axis 40 and the longitudinal axis 42. Further, the curved portion 48 is illustrated as defining a second radius of curvature 74 in the loaded second position, the second radius of curvature 74 being greater than the first radius of curvature 50 of the frame 28 in the unloaded first position (see FIG. 1). In some aspects, the first radius of curvature 50 (see FIG. 1) is between about 1% and about 50% of the second radius of curvature 74, or between about 1% and about 25% of the second radius of curvature 74, or between about 10% and about 20% of the second radius of curvature 74, or about 20% of the second radius of curvature 74.

Thus, the frame 28 flexes rearwardly in response to a load, and the grooves 62 compress the inserts 64, which are deformable because the second hardness of the second material of the inserts 64 is less than the first hardness of the first material of the frame 28. This deformation causes the front side 30 of the frame 28 to expand in length relative to the rear side 32 of the frame 28 due to the rear openings of the grooves 62. Elongation of the front side 30 increases the suspension force that is applied to the fabric component 22, which in turn causes the fabric component 22 to continue flexing forward from the horizontal plane (not shown) and support the user.

Figure 6:
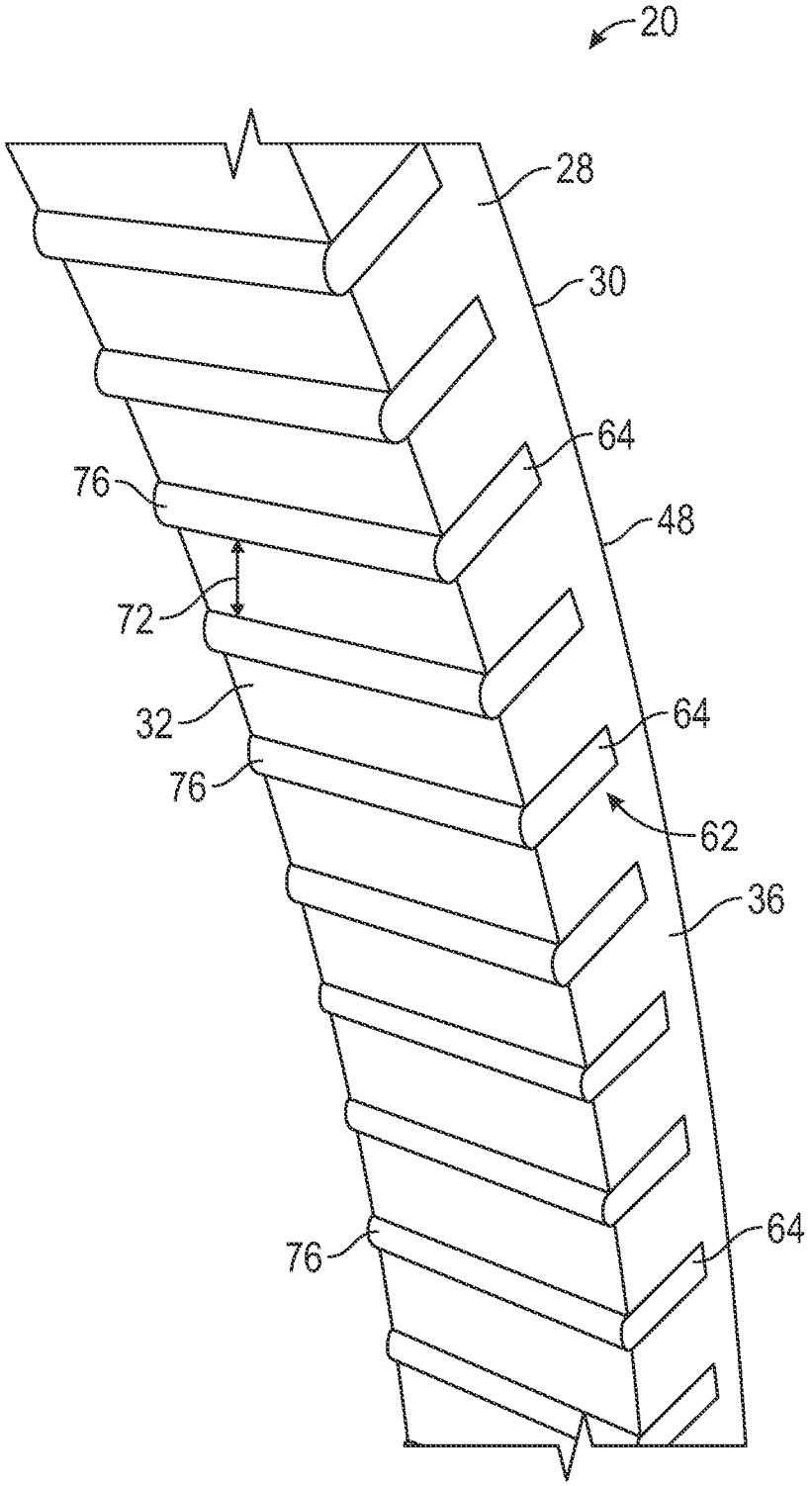
FIG. 6 is a detail view of a support frame in the seat assembly of FIG. 4.

Referring now to FIG. 6, the inserts 64 are illustrated as being deformed when the frame 28 is in the second position. Specifically, the load applied to the fabric component 22 (see FIG. 4) causes the frame to flex rearwardly and compress the grooves 62. This compression also deforms each of the inserts 64 that are disposed within each of the respective grooves 62, because the inserts 64 are formed of a softer material than the frame 28. Further, because the grooves 62 are open on the rear side 32 of the frame 28, ends 76 of the deformed inserts 64 protrude outwardly from the grooves 62 as illustrated. In some aspects, the grooves 62 include rear cavities (not shown) that are configured to receive the ends 76 of the inserts 64 when they are deformed. In this way, the ends 76 of the inserts 64 may not extend out of the grooves 62 when the inserts 64 are deformed. Further, it will be understood that the first and second materials of the frame 28 and inserts 64, respectively, are elastic materials, meaning that the seat assembly 20 includes spring-like qualities that allow the seat assembly 20 to return to its unloaded state, e.g., the first position (see FIGS. 1-3), after a load is removed therefrom. Thus, depending on the number of grooves 62, the position of the grooves 62 along the frame 28, the material properties of the inserts 64, and other factors, the flexural compliance and resulting comfort of the seat assembly 20 can be tuned or modulated to achieve the desired performance.

Figure 7:
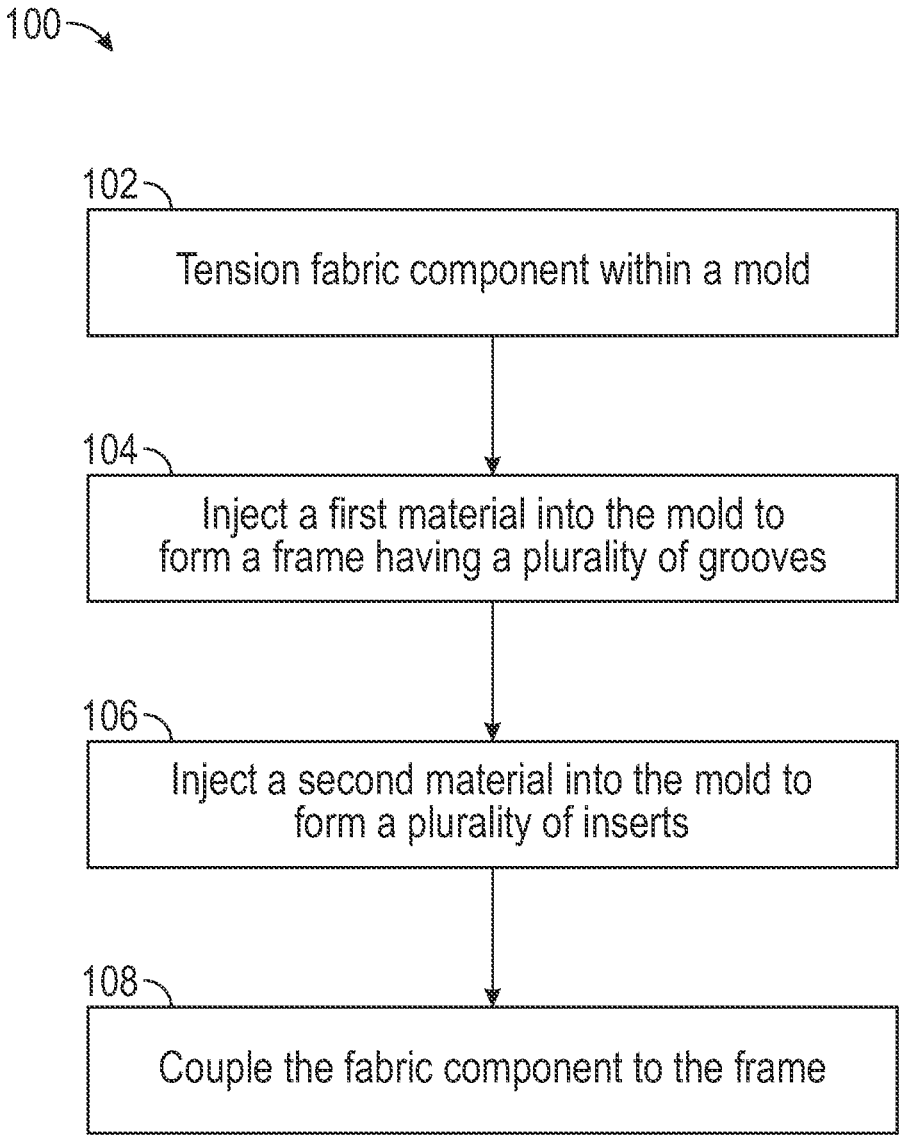
FIG. 7 is a flowchart representation of an example method of manufacturing the seat assembly of FIG. 1.

FIG. 7 depicts a flowchart illustrating a method 100 for manufacturing the seat assembly 20. While the example method is described with reference to the flowchart illustrated in FIG. 7, various other methods of manufacturing the seat assembly 20 may alternatively be used. For example, the order of execution of the blocks may be rearranged, changed, eliminated, and/or combined to perform the method 100. Further, it is contemplated that the seat assembly 20 may be manufactured in various ways or steps and by using various machinery or materials, such as those described in U.S. Pat. No. 7,618,572, entitled "Method and Apparatus for Manufacturing Load Bearing Fabric Support Structures," U.S. Pat. No. 7,677,873, entitled "Apparatus and Method for Molding onto a Stretched Blank," U.S. Pat. No. 8,066,501, entitled "Apparatus and Method for Molding onto a Stretched Blank," and U.S. Pat. No. 976,211, entitled "Apparatus and Method for Manufacturing a Load Bearing Fabric Surface," all of which are assigned to Illinois Tool Works Inc., and are hereby incorporated by reference in their entirety. It is further contemplated that various alternative methods of manufacturing can be used to manufacture the seat assembly 20, such as types of additive manufacturing or subtractive manufacturing.

Still referring to FIG. 7, step 102 of the method 100 includes tensioning the fabric component 22 within a mold of a molding compress. In some aspects, the fabric component 22 is tensioned on a stretching assembly by providing a fabric blank on a first molding block and applying tension thereto using the stretching assembly. Step 104 of the method 100 includes injecting a first material into the mold to form the frame 28. For example, a liquid material, such as thermoplastic material, through a mold cavity designed and arranged to be filled with the liquid material. In some aspects, the mold is designed such that injection of the first material into the mold forms the plurality of grooves 62 in the frame 28, e.g., along a rear side of the frame 28. Further, cooling lines may be installed throughout the molding compress the first molding block, a second molding block, or both. The cooling lines are configured to remove heat from certain areas or portions of the mold at certain times within the method 100. For example, cooling lines may be designed to manufacture the frame 28 with thinner and more flexible sections, or thicker and less flexible sections. In addition, the cooling lines may be designed to prevent annealing portions of the fabric blank.

Step 106 of the method 100 includes injecting a second material into the mold to form the plurality of inserts 64. In some aspects, the plurality of inserts 64 are formed directly in the plurality of grooves 62, or the plurality of inserts 64 are formed in a separate mold before being inserted into the grooves 62. As discussed above, the first material defines a first hardness that is greater than a second hardness defined by the second material, and the second hardness may be between about 25% and about 99% of the first hardness. Further, step 108 of the method 100 includes coupling the fabric component 22 to the mold, e.g., coupling the fastener 60 to the fabric component 22 and an inner periphery of the frame 28. In some examples, the method 100 further includes opening the molding compress, removing or ejecting the seat assembly 20 therefrom, and/or removing excess fabric from the seat assembly 20.

Although various aspects are herein disclosed in the context of certain preferred embodiments, implementations, and examples, it will be understood by those skilled in the art that the present invention extends beyond the specifically disclosed embodiments to other alternative embodiments and/or uses of the inventive aspects and obvious modifications and equivalents thereof. In addition, while a number of variations of the aspects have been noted, other modifications, which are within their scope, will be readily apparent to those of skill in the art based upon this disclosure. It should be also understood that the scope of this disclosure includes the various combinations or sub-combinations of the specific features and aspects of the embodiments disclosed herein, such that the various features, modes of implementation and operation, and aspects of the disclosed subject matter may be combined with or substituted for one another. Thus, it is intended that the scope of the present invention herein disclosed should not be limited by the particular disclosed embodiments or implementations described above, but should be determined only by a fair reading of the claims.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. A seat assembly, comprising:

a frame comprising a first material that defines a first hardness, the frame including a first side, a second side opposite the first side, a top side, a right side that extends downward from the top side, and a left side that extends downward from the top side;

a fabric component coupled to the first side of the frame;

a plurality of grooves disposed within the second side of the frame, the plurality of grooves including first grooves along the right side of the frame and second grooves along the left side of the frame; and a plurality of inserts, wherein each insert of the plurality of inserts is disposed within each respective groove in the plurality of grooves, wherein each insert of the plurality of inserts comprises a second material, the second material defining a second hardness that is less than the first hardness, wherein the frame defines a linear portion that extends in a substantially parallel direction with respect to a longitudinal axis and a curved portion that extends rearwardly of the linear portion, and wherein a majority of inserts of the plurality of inserts are disposed within the curved portion of the frame.

2. The seat assembly of claim 1, wherein the second hardness is between about 25% and about 99% of the first hardness.

3. The seat assembly of claim 1, wherein each insert of the plurality of inserts is configured to deform in response to applying a load to the first side of the frame such that the curved portion of the frame is configured to flex in a rearward direction.

4. The seat assembly of claim 1, wherein the plurality of inserts are at least partially visible when viewed from the second side, the right side, and the left side.

5. The seat assembly of claim 1, wherein the first material defines a first modulus of elasticity and the second material defines a second modulus of elasticity that is between about 25% and about 99% of the first modulus of elasticity.

6. A seat assembly, comprising: a frame defining a first length and including a first side and a second side opposite the first side;

a fabric component coupled to the first side of the frame;

a plurality of grooves disposed within the second side of the frame; and a plurality of inserts disposed within the plurality of grooves, wherein the plurality of inserts defines an insert area having a second length that is less than the first length, wherein the frame defines a linear portion that extends in a substantially parallel direction with respect to a longitudinal axis and a curved portion that extends rearwardly of the linear portion, and wherein the plurality of inserts is disposed within the curved portion of the frame.

7. The seat assembly of claim 6, wherein the frame comprises a first material that defines a first hardness and the plurality of inserts comprises a second material that defines a second hardness, and wherein the second hardness is less than the first hardness.

8. The seat assembly of claim 6, wherein a third length of the linear portion is greater than a fourth length of the curved portion.

9. The seat assembly of claim 6, wherein the curved portion defines a first radius of curvature in an unloaded state and a second radius of curvature in a loaded state, and wherein the second radius of curvature is greater than the first radius of curvature.

10. The seat assembly of claim 6, wherein the insert area of the plurality of inserts is located between about 40% and about 90% of the first length of the frame.

11. The seat assembly of claim 6, wherein the frame further includes a third side and a fourth side each coupled to the first side and the second side, and wherein the plurality of inserts are at least partially visible when viewed from the second side, the third side, and the fourth side.

12. The seat assembly of claim 6, wherein the plurality of grooves includes between one and 100 grooves.

* * * * *